US011199811B2

(12) United States Patent
Jang et al.

(10) Patent No.: US 11,199,811 B2
(45) Date of Patent: Dec. 14, 2021

(54) DEVELOPING DEVICE WITH STRUCTURE TO RELEASE INNER PRESSURE

(71) Applicant: HEWLETT-PACKARD DEVELOPMENT COMPANY, L.P., Spring, TX (US)

(72) Inventors: Hojin Jang, Gyeonggi-do (KR); Jong-Hyun Park, Gyeonggi-do (KR); Donggeun Lee, Gyeonggi-do (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/258,021

(22) PCT Filed: May 23, 2019

(86) PCT No.: PCT/US2019/033772
§ 371 (c)(1),
(2) Date: Jan. 5, 2021

(87) PCT Pub. No.: WO2020/091843
PCT Pub. Date: May 7, 2020

(65) Prior Publication Data

US 2021/0278802 A1 Sep. 9, 2021

(30) Foreign Application Priority Data

Nov. 1, 2018 (KR) ..... 10-2018-0133013

(51) Int. Cl.
*G03G 15/08* (2006.01)
*G03G 21/20* (2006.01)

(52) U.S. Cl.
CPC ..... *G03G 21/206* (2013.01); *G03G 15/0865* (2013.01)

(58) Field of Classification Search
CPC ..... G03G 21/206; G03G 15/0865
See application file for complete search history.

(56) References Cited

U.S. PATENT DOCUMENTS 9,709,927 B1 * 7/2017 Bacelieri ..... G03G 15/0921
10,289,027 B2 * 5/2019 Sako ..... G03G 15/0891
(Continued)

FOREIGN PATENT DOCUMENTS

JP 2011174983 9/2011
JP 2014178661 A * 9/2014
(Continued)

*Primary Examiner* — Sevan A Aydin
(74) *Attorney, Agent, or Firm* — Trop Pruner & Hu, P.C.

(57) ABSTRACT

The developing device includes a developing roller, a developer conveying unit, a developer discharge unit, and an air discharge port. The developer conveying unit includes a developing chamber provided with the developing roller and extending in a longitudinal direction of the developing roller, a stirring chamber arranged in parallel to the developing chamber, and a barrier wall having a first communication port and a second communication port, at respective ends in the longitudinal direction, to connect the developing chamber with the stirring chamber. The developer discharge unit extends from the developer conveying unit in the longitudinal direction of the developing roller and includes a developer discharge port to discharge excess developer. The air discharge port is to house a filter to filter a developer, the air discharge port being provided between the developer conveying unit and the developer discharge unit to discharge air in the developer conveying unit.

15 Claims, 8 Drawing Sheets

(56) References Cited

U.S. PATENT DOCUMENTS

| | | | | |
|---|---|---|---|---|
| 10,663,881 | B1* | 5/2020 | Wakai | G03G 15/0812 |
| 2006/0078348 | A1 | 4/2006 | Watanabe et al. | |
| 2011/0311263 | A1 | 12/2011 | Mizuta | |
| 2013/0170862 | A1 | 7/2013 | Leemhuis et al. | |
| 2016/0334752 | A1* | 11/2016 | Lee | G03G 21/105 |
| 2017/0023878 | A1* | 1/2017 | Uchida | G03G 15/0887 |
| 2017/0023908 | A1* | 1/2017 | Miura | G03G 21/105 |
| 2017/0227891 | A1* | 8/2017 | Shibata | G03G 15/0942 |
| 2017/0248868 | A1* | 8/2017 | Iwata | G03G 15/0812 |
| 2017/0336734 | A1* | 11/2017 | Nagashima | G03G 15/0898 |
| 2018/0004132 | A1* | 1/2018 | Fukui | G03G 21/0011 |
| 2018/0032024 | A1* | 2/2018 | Yamashita | G03G 21/206 |
| 2018/0120731 | A1* | 5/2018 | Nakamura | G03G 15/0865 |
| 2018/0129150 | A1* | 5/2018 | Taniguchi | G03G 21/206 |
| 2018/0157192 | A1 | 6/2018 | Oikawa et al. | |
| 2019/0286011 | A1* | 9/2019 | Nieda | G03G 15/0886 |
| 2019/0302691 | A1* | 10/2019 | Kawahito | G03G 15/0875 |
| 2020/0192247 | A1* | 6/2020 | Park | G03G 21/10 |
| 2021/0109457 | A1* | 4/2021 | Wada | G03G 21/1814 |

FOREIGN PATENT DOCUMENTS

| | | | |
|---|---|---|---|
| JP | 6385903 | B2 | 9/2018 |
| JP | 2018151678 | A | 9/2018 |

* cited by examiner

DEVELOPING DEVICE WITH STRUCTURE TO RELEASE INNER PRESSURE

BACKGROUND

An image forming device using an electrophotographic method supplies toner to an electrostatic latent image formed on a photoconductor to form a visible toner image on the photoconductor, transfers the toner image to a recording medium, fixes the transferred toner image on the recording medium, and prints the image on the recording medium. The developing device accommodates toner and supplies the toner to the electrostatic latent image formed on the photoconductor to form a visible toner image on the photoconductor.

DETAILED DESCRIPTION

Figure 1:
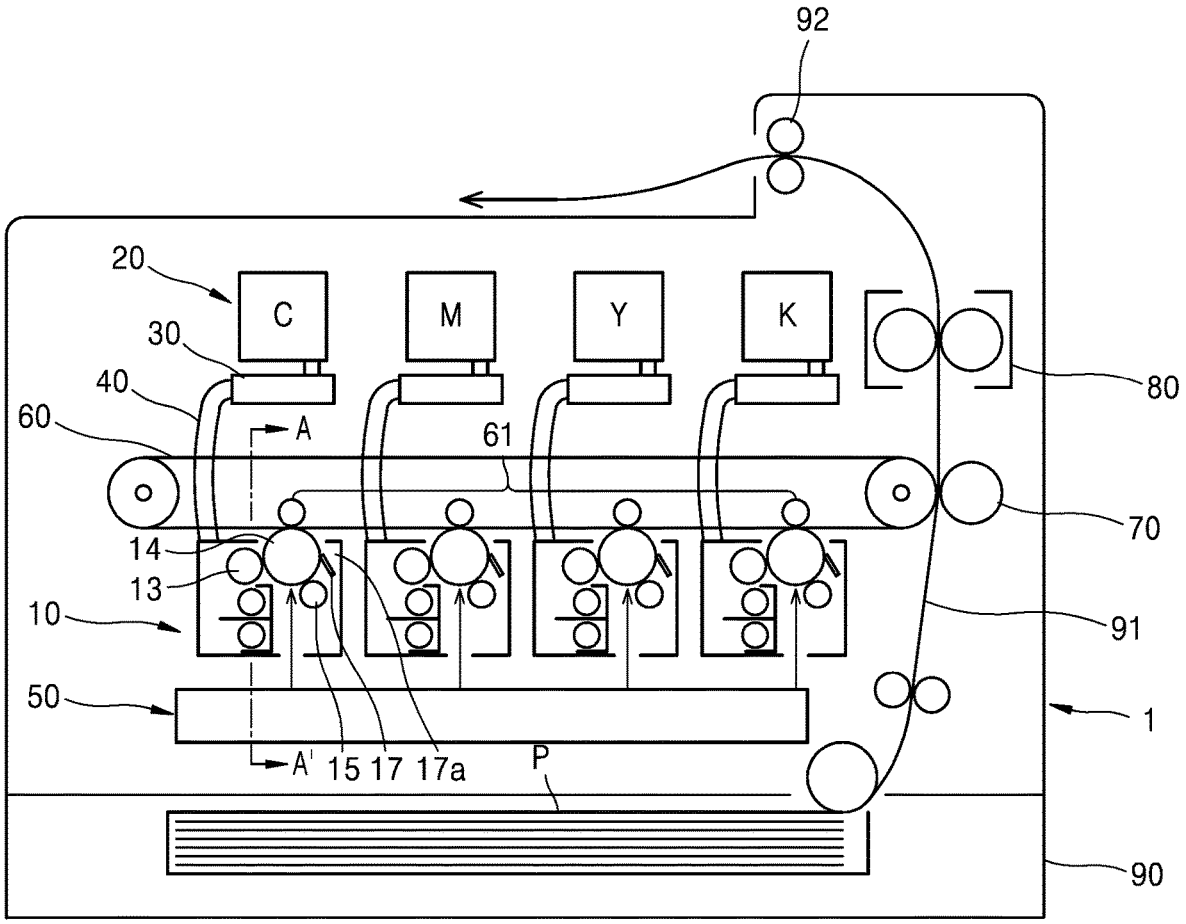
FIG. 1 is a configuration diagram of an example of an electrophotographic image forming device.

Hereinafter, examples of a developing device and an electrophotographic image forming device employing the same will be described in detail with reference to the accompanying drawings. The same reference numerals are used to denote the same elements, and repeated descriptions thereof will be omitted.

A two-component developing method using toner and a carrier as a developer includes an automatic developer replenishment (ADR) method in which a new developer is supplied to the developing device and an excess developer is discharged from the developing device. As the printing speed increases, the rotation speed of a developing roller in the developing device also increases. When the developing roller is rotated at a high speed, the amount of air introduced into the developing device is increased, so that air pressure in the developing device may be increased. According to the ADR method, the increase in the air pressure in the developing device may affect the amount of air discharged through a developer discharge port and the amount of developer discharged from the developing device by air.

FIG. 1 is a configuration diagram of an example of an electrophotographic image forming device. An electrophotographic image forming device of the present example prints a color image using an electrophotographic method. Referring to FIG. 1, the image forming device includes a plurality of developing devices 10, an exposure device 50, a transfer device, and a fixing device 80.

The image forming device may further include a plurality of developer cartridges 20 containing a developer. The plurality of developer cartridges 20 are connected to the plurality of developing devices 10, respectively, and the developers accommodated in the plurality of developer cartridges 20 are supplied to the plurality of developing devices 10, respectively. The plurality of developer cartridges 20 and the plurality of developing devices 10 are detachable from the main body 1 and may be individually replaced.

As an example, the plurality of developing devices 10 may include a plurality of developing devices 10C, 10M, 10Y, and 10K for forming toner images of cyan (C), magenta (M), yellow (Y), and black (K). The plurality of developer cartridges 20 may include a plurality of developer cartridges 20C, 20M, 20Y, and 20K containing developers of colors C, M, Y, and K for supplying to the plurality of developing devices 10C, 10M, 10Y, and 10K, respectively. Hereinafter, reference numerals with C, M, Y, and K refer to components for developing the developers of colors C, M, Y, and K, respectively, unless otherwise specified.

Figure 2:
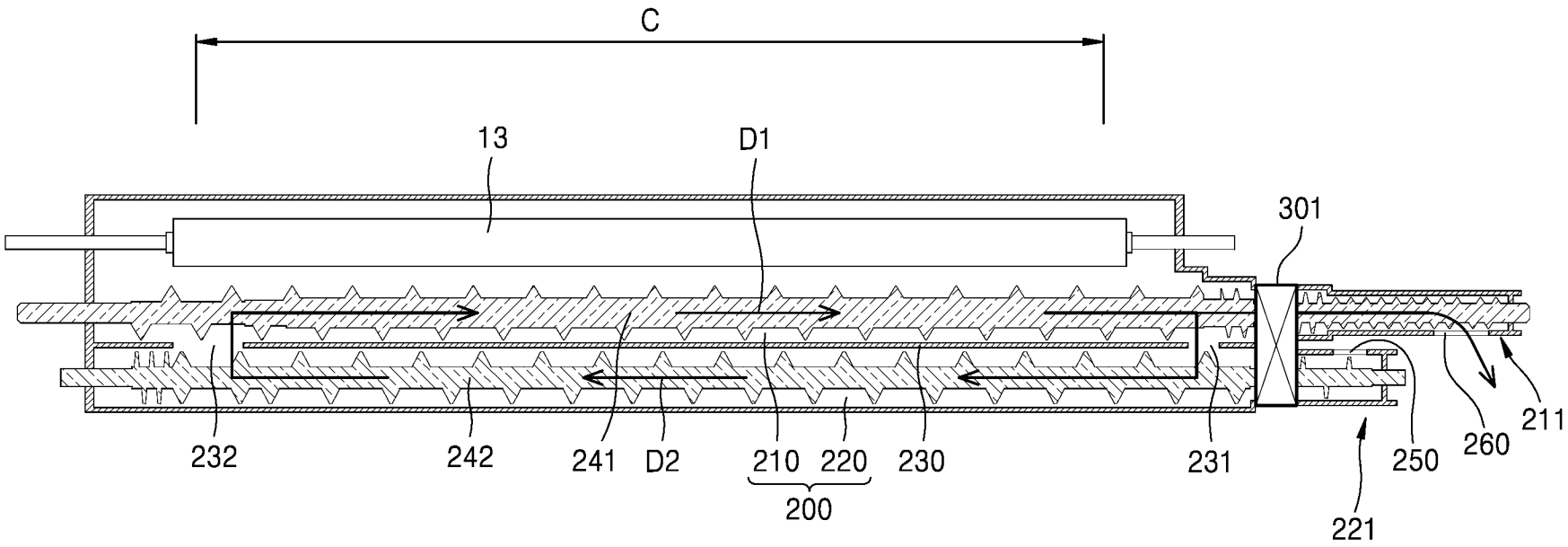
FIG. 2 is a cross-sectional view taken along line A-A' of an example of a developing device shown in FIG. 1.
Figure 3:
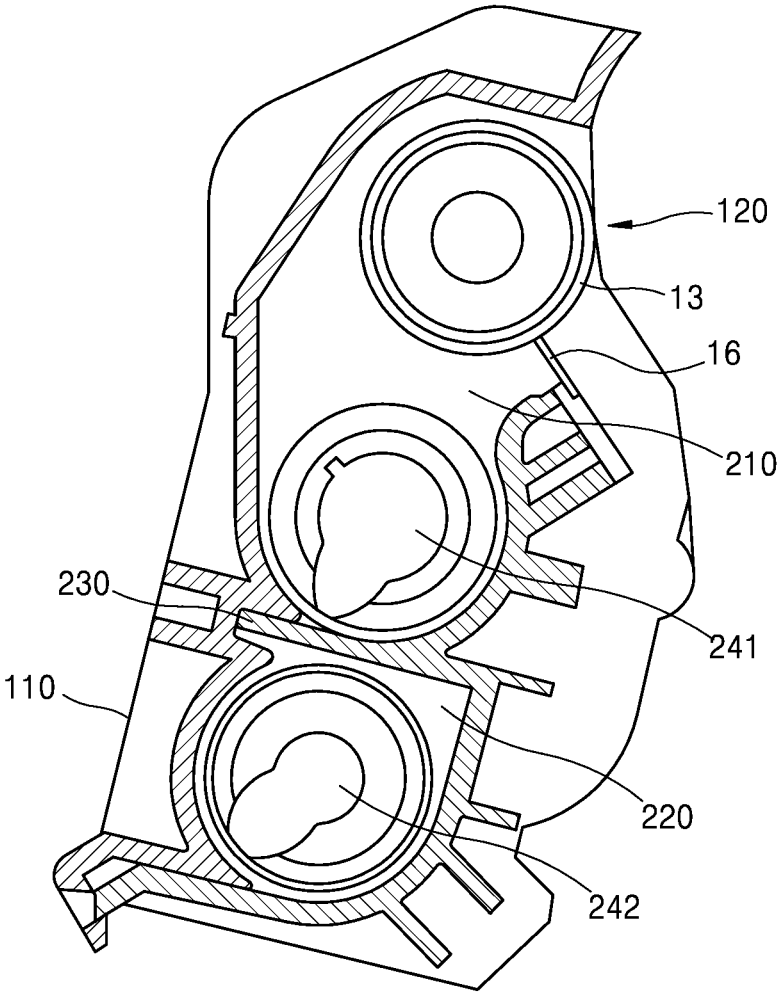
FIG. 3 is a sectional view taken along line B-B' shown in FIG. 2.

FIG. 2 is a cross-sectional view taken along line A-A' of an example of the developing device 10 shown in FIG. 1, and FIG. 3 is a sectional view taken along line B-B' of FIG. 2. Referring to FIGS. 1 to 3, the developing device 10 may include a photosensitive drum 14 on which an electrostatic latent image is formed and a developing roller 13 for supplying toner to the electrostatic latent image to develop the electrostatic latent image into a visible toner image. The photosensitive drum 14 is an example of a photoconductor on which an electrostatic latent image is formed, and may include a conductive metal pipe and a photosensitive layer formed on the periphery thereof. A charging roller 15 is an example of a charger that charges the photosensitive drum 14 to have a uniform surface electric potential. Instead of the charging roller 15, a charging brush, a corona charger, or the like may be employed.

Although not shown in the drawings, the developing device 10 may further include a charging roller cleaner for removing foreign materials such as a developer or dust adhered to the charging roller 15, a cleaning member 17 for removing a developer remaining on a surface of the photosensitive drum 14 after an intermediate transfer process described later below, and a regulating member for regulating the amount of a developer supplied to an area where the photosensitive drum 14 and the developing roller 13 face each other. A waste developer may be accommodated in a waste developer accommodating portion 17*a*. The cleaning member 17 may be, for example, a cleaning blade that contacts a surface of the photosensitive drum 14 to scrape a developer. Although not shown in the drawings, the cleaning member 17 may be a cleaning brush that contacts a surface of the photosensitive drum 14 while rotating and scrapes a developer.

The developer accommodated in the developer cartridge 20, that is, toner and a carrier, is supplied to the developing device 10. The developing roller 13 is located apart from the photosensitive drum 14. The distance between an outer peripheral surface of the developing roller 13 and an outer peripheral surface of the photosensitive drum 14 may be, for example, several tens to several hundreds of microns. The developing roller 13 may have a configuration in which a magnet is arranged in a rotatable developing sleeve. In the developing device 10, the toner is mixed with the carrier, and the toner is attached to the surface of a magnetic carrier. The magnetic carrier is attached to a surface of the developing roller 13 and conveyed to a developing area where the photosensitive drum 14 and the developing roller 13 face each other. A regulating member 16 regulates the amount of a developer conveyed to the developing area. The toner is supplied to the photosensitive drum 14 by a developing bias voltage applied between the developing roller 13 and the photosensitive drum 14 to develop the electrostatic latent image formed on the surface of the photosensitive drum 14 into a visible toner image. The developing device 10 of the present example employs the ADR method. In order to keep the amount of a developer in the developing device 10 constant, an excess developer is discharged to the outside of the developing device 10.

The exposure device 50, which irradiates light modulated corresponding to image information onto the photosensitive drum 14 to form an electrostatic latent image on the photosensitive drum 14, includes a laser scanning unit (LSU) using a laser diode as a light source or a light emitting diode (LED) exposure device using an LED as a light source, as an representative example.

A transfer device transfers a toner image formed on the photosensitive drum 14 to a recording medium P. In the present example, an intermediate transfer type transfer device is employed. As an example, the intermediate transfer type transfer device may include an intermediate transfer belt 60, an intermediate transfer roller 61, and a transfer roller 70.

The intermediate transfer belt 60 temporarily accommodates a toner image developed on the photosensitive drum 14 of the plurality of developing devices 10C, 10M, 10Y, and 10K. A plurality of intermediate transfer rollers 61 are arranged at a position facing the photosensitive drum 14 of the plurality of developing devices 10C, 10M, 10Y, and 10K with the intermediate transfer belt 60 therebetween. A plurality of intermediate transfer rollers 61 are supplied with an intermediate transfer bias for intermediately transferring the toner image developed on the photosensitive drum 14 to the intermediate transfer belt 60. Instead of the intermediate transfer roller 61, a corona transfer device or a pin scorotron type transfer device may be employed.

The transfer roller 70 is located facing the intermediate transfer belt 60. A transfer bias voltage for transferring the toner image transferred onto the intermediate transfer belt 60 to the recording medium P is applied to the transfer roller 70.

The fixing device 80 applies heat and/or pressure to the toner image transferred onto the recording medium P to fix the toner image on the recording medium P. A configuration of the fixing device 80 is not limited to the example shown in FIG. 1.

According to the above configuration, the exposure device 50 scans the photosensitive drum 14 of the plurality of developing devices 10C, 10M, 10Y, and 10K with a plurality of light beams modulated corresponding to image information of each color to form an electrostatic latent image on the photosensitive drum 14. The electrostatic latent image of the photosensitive drum 14 of the plurality of developing devices 10C, 10M, 10Y, and 10K is developed into a visible toner image by C, M, Y, and K developer supplied from the plurality of developer cartridges 20C, 20M, 20Y, and 20K to the plurality of developing devices 10C, 10M, 10Y, and 10K. The developed toner images are intermediately transferred onto the intermediate transfer belt 60 sequentially. The recording medium P mounted on a paper feeding device 90 is conveyed between the transfer roller 70 and the intermediate transfer belt 60 along a paper feeding path 91. The toner image intermediately transferred onto the intermediate transfer belt 60 is transferred onto the recording medium P by a transfer bias voltage applied to the transfer roller 70. When the recording medium P passes the fixing device 80, the toner image is fixed to the recording medium P by heat and pressure. The recording medium P to which the toner image is fixed is discharged by a discharge roller 92.

The developer accommodated in the developer cartridge 20 is supplied to the developing device 10. When the developer accommodated in the developer cartridge 20 is exhausted, the developer cartridge 20 may be replaced with a new developer cartridge 20 or a new developer may be charged into the developer cartridge 20.

The image forming device may further include a developer supply unit 30. The developer supply unit 30 receives the developer from the developer cartridge 20 and supplies the developer to the developing device 10. The developer supply unit 30 is connected to the developing device 10 by a supply duct 40. Although not shown in the drawings, the developer supply unit 30 may be omitted, and the supply duct 40 may directly connect the developer cartridge 20 to the developer cartridge 10.

Referring to FIGS. 2 and 3, the developing device 10 includes a developing casing 110 and the developing roller 13 rotatably supported by the developing casing 110. The developer is accommodated in the developing casing 110. The developer may be supplied from the developer cartridge 20 as described above. A developer conveying unit 200 is provided in the developing casing 110. The developer is conveyed along the developer conveying unit 200 and stirred. The developing roller 13 is installed in the developer conveying unit 200. The developer conveying unit 200 may include a developing chamber 210 and a stirring chamber 220.

The developing chamber 210 is provided with an opening 120 opened toward the photosensitive drum 14. The developing roller 13 is installed in the developing chamber 210. The developing roller 13 is partially exposed to the outside of the developing chamber 210 through the opening 120 and the exposed portion of the developing roller 13 faces the photosensitive drum 14. The developing roller 13 supplies toner accommodated in the developing chamber 210 to the electrostatic latent image formed on the photosensitive drum 14 through the opening 120 to develop the electrostatic latent image into a toner image. The stirring chamber 220 is separated from the developing chamber 210 by a barrier wall 230.

The developing chamber 210 and the stirring chamber 220 may be provided with first and second conveying members 241 and 242, respectively. The first and second conveying members 241 and 242 stir toner and a carrier while conveying developers in the developing chamber 210 and the stirring chamber 220 in a longitudinal direction of the developing roller 13, respectively. The first and second conveying members 241 and 242 may be, for example, an auger having a helical wing. The first and second conveying members 241 and 242 carry the developers in opposite directions to each other. For example, the first and second conveying members 241 and 242 convey the developers in first and second directions D1 and D2, respectively. First and second communication ports 231 and 232 are respectively provided at end portions of the barrier wall 230 in a longitudinal direction for communication of the developing chamber 210 with the stirring chamber 220. The developer in the developing chamber 210 is conveyed from the second communication port 232 in the first direction D1 by the first conveying member 241. The developer is conveyed to the stirring chamber 220 through the first communication port 231 provided at the end of the barrier wall 230 in the first direction D1. The developer in the stirring chamber 220 is conveyed from the first communication port 231 in the second direction D2 by the second conveying member 242. The developer is conveyed to the developing chamber 210 through the second communication port 232 provided at the end of the barrier wall 230 in the second direction D2. According to this configuration, the developer is circulated along a circulation path formed by the developing chamber 210, the first communication port 231, the stirring chamber 220, the second communication port 232, and the developing chamber 210. Some of the developer conveyed in the first direction D1 in the developing chamber 210 is attached to the developing roller 13 and toner in the developer is supplied to the photosensitive drum 14.

The developing device 10 of the present example employing the ADR method provides a developer supply port 250 and a developer discharge port 260.

The developer is supplied from the developer cartridge 20 to the inside of the developing device 10, that is, the developer conveying unit 200, through the developer supply port 250. The developer supply port 250 is located outside an effective image area C of the developing roller 13. The effective image area C refers to an area effectively used for image formation among a length of the developing roller 13. A length of the effective image area C may be slightly longer than a width of the recording medium P of the maximum size used in the image forming device. The effective image area C may be an inside of the first communication port 231 and the second communication port 232. The developer supply port 250 may be located outside the first communication port 231 and the second communication port 232.

As an example, the developing device 10 may be provided with a developer supply unit 221 extending from the developer conveying unit 200 in the longitudinal direction of the developing roller 13. The developer supply port 250 may be provided in the developer supply unit 221. For example, the developer supply unit 221 may extend from an upstream side of the stirring chamber 220 in the first direction D1 with reference to a flow direction of the developer in the stirring chamber 220, that is, the second direction D2. The second conveying member 242 extends inside the developer supply unit 221. The developer supplied to the stirring chamber 220 through the developer supply port 250 is conveyed in the second direction D2 by the second conveying member 242.

An excess developer is discharged to the outside of the developing device 10 through the developer discharge port 260. The discharged excess developer may be accommodated in a waste developer container (not shown). The developer discharge port 260 is located outside the effective image area C of the developing roller 13. The developer discharge port 260 may be located outside the first communication port 231 and the second communication port 232. As an example, the developing device 10 may be provided with a developer discharge unit 211 extending from the developer conveying unit 200 in the longitudinal direction of the developing roller 13. The developer discharge port 260 may be provided in the developer discharge unit 211. For example, the developer discharge unit 211 may extend from a downstream side of the developing chamber 210 in the first direction D1 with reference to a flow direction of the developer in the developing chamber 2100, that is, the first direction D1. The first conveying member 241 extends inside the developer discharge unit 211. The excess developer is conveyed by the first conveying member 241 and is discharged to the outside of the developing device 10 through the developer discharge port 260.

When the developer is discharged through the developer discharge port 260, air in the developing chamber 210 is also discharged. As a printing speed of the image forming device increases, a rotation speed of the developing roller 13 also increases. The inflow speed and amount of air introduced into the developing chamber 210 from the outside may be increased. Then, an air pressure in the developing chamber 210 is increased, and the discharge pressure of air through the developer discharge port 260 is increased. The discharge pressure of the air increases a discharge speed of a developer through the developer discharge port 260, so that the developer may be excessively discharged. The excessive discharge of the developer excessively reduces the amount of the developer in the development chamber 210, and the amount of the developer in the development chamber 210 may become insufficient, which may cause a decrease in image density.

The developing device 10 of the present example has a structure capable of releasing an internal air pressure between the developer conveying unit 200 and the developer discharge unit 211. The developing device 10 of the present example reduces an air pressure in the developing device 10 by partially discharging air in the developer conveying unit 200 to the outside between the developer conveying unit 200 and the developer discharge unit 211. Thus, the amount of air discharged to the developer discharge port 260 may be reduced, and the developer may be prevented from being excessively discharged to the developer discharge port 260.

Figure 4:
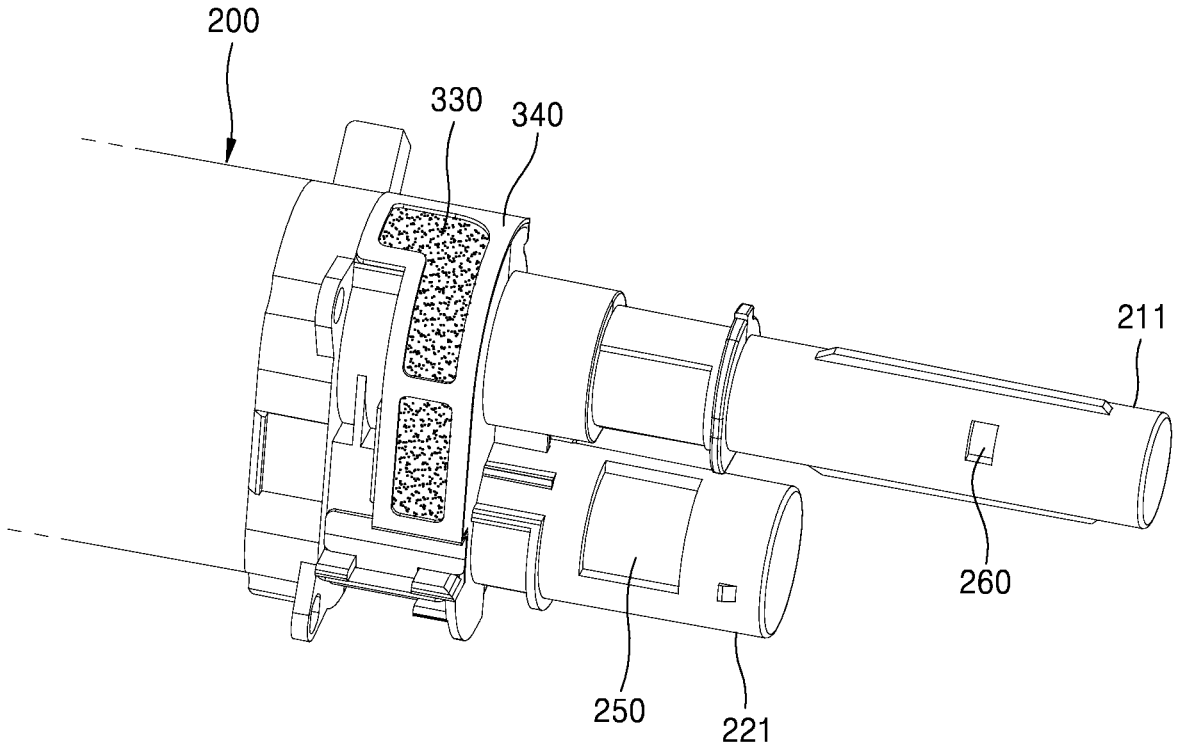
FIG. 4 is a partial perspective view of an example of a developing device to which an air pressure relief structure is applied.
Figure 5:
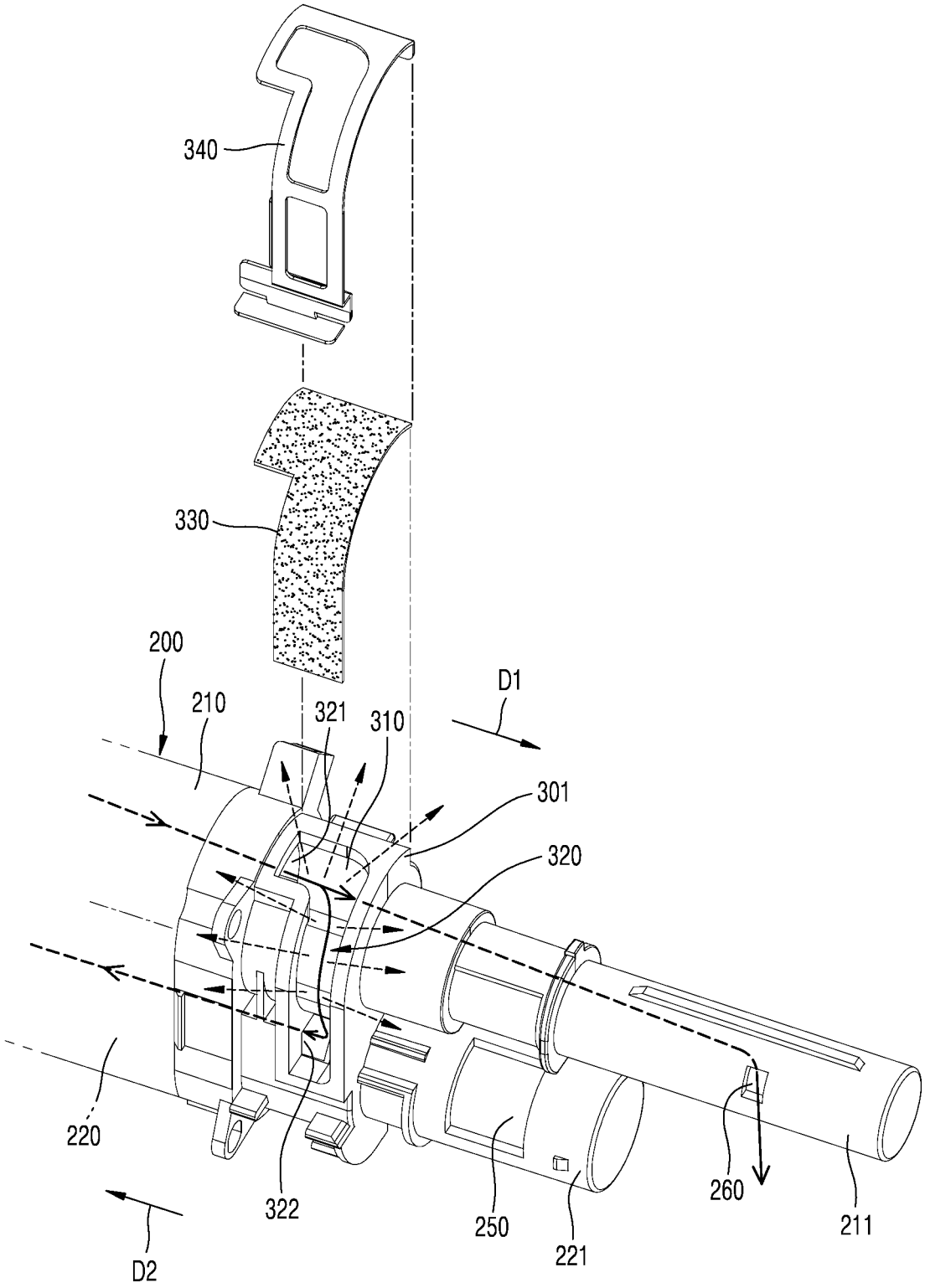
FIG. 5 is a partially exploded perspective view of an example of the developing device to which the air pressure relief structure is applied, shown in FIG. 4.

FIG. 4 is a partial perspective view of an example of the developing device 10 to which an air pressure relief structure is applied. FIG. 5 is a partially exploded perspective view of an example of the developing device 10 to which the air pressure relief structure is applied, shown in FIG. 4. Referring to FIGS. 4 and 5, an air discharge port 310 is provided between the developer conveying unit 200 and the developer discharge unit 211 such that air in the developer conveying unit 200 is discharged. For example, the air discharge port 310 may be located between the developing chamber 210 and the developer discharge unit 211. The air discharge port 310 is provided with a filter 330 for filtering a developer so that the developer is not discharged together with air.

According to such a configuration, the air discharged from the developing chamber 210 is partially discharged to the outside of the developer conveying unit 200 through the air discharge port 310 and the remaining air flows along the developer discharge unit 211 and is discharged to the outside through the developer discharge port 260. An air pressure in the developer discharge unit 211 becomes less than an air pressure in the developing chamber 210 since the air is partially discharged through the air discharge port 310 before reaching the developer discharge port 260. Therefore, the influence of increase in the air pressure in the developing chamber 210 on a discharge speed and the discharge amount of the developer through the developer discharge port 260 is reduced, and excessive discharge of the developer may be prevented. Also, an excessive increase in an air pressure in the developing device 10 may be prevented even if the developing roller 13 is rotated at a high speed, excessive discharge of the developer may be prevented, and the amount of the developer in the developing chamber 210 may be maintained at an appropriate level. In addition, an excessive increase of the air pressure in the developer conveying unit 200 is prevented, and a developer which is carried by air and directed toward the air discharge port 310 is blocked by the filter 330 so that air passes through the air discharge port 310. Accordingly, it is possible to prevent the developer from being scattered into the image forming device in a process of lowering the air pressure in the developing device 10.

Referring to FIG. 5, the developing device 10 includes an internal circulation path 320 provided between the developer conveying unit 200 and the developer discharge unit 211 and connecting the developing chamber 210 to the stirring chamber 220 to form an air passage. Some of air moving in the first direction D1 from the developing chamber 210 is discharged to the outside of the developer conveying unit 200 through the air discharge port 310 and some of the air is circulated to the stirring chamber 220 through the internal circulation path 320, and the remaining is discharged through the developer discharge port 260. Therefore, the influence of the increase of the air pressure in the developing chamber 210 on the discharge speed and the discharge amount of the developer through the developer discharge port 260 may be further reduced, and excessive discharge of the developer may be prevented.

The internal circulation path 320 may include first and second connection openings 321 and 322 connected to the developing chamber 210 and the stirring chamber 220, respectively. The first connection opening 321 is connected to a downstream side of the developing chamber 210 with reference to a flow direction of the developer in the developing chamber 210, that is, the first direction D1. The second connection opening 322 is connected to an upstream side of the stirring chamber 220 with reference to a flow direction of the developer in the stirring chamber 220, that is, the second direction D2. The first and second connection openings 321 and 322 are located outside the first communication port 231.

In the present example, the developing chamber 210 is above the stirring chamber 220 in a gravity direction. The developer is heavier than air. Accordingly, in the developing chamber 210 and the stirring chamber 220, the developer is mainly moved along the lower region, and the air is mainly moved along the upper region. The first connection opening 321 communicates with the upper region of the developing chamber 210 in the gravity direction such that air may be easily circulated from the developing chamber 210 to the stirring chamber 220 through the internal circulation path 320. The second connection opening 322 communicates with the upper region of the stirring chamber 220 in the gravity direction. According to this configuration, air may be easily moved from the developing chamber 210 to the stirring chamber 220 via the internal circulation path 320. The second connection opening 322 may be opened in the flow direction of the developer in the stirring chamber 220, that is, in the second direction D2. According to this configuration, since the flow direction of the air introduced into the stirring chamber 220 through the internal circulation path 320 is the second direction D2, the developer in the stirring chamber 220 may easily flow in the second direction D2.

The air discharge port 310 may be open in an outer wall forming the internal circulation path 320, that is, a circulation path forming housing 301. The air discharge port 310 may be formed in an upper region of the circulation path forming housing 301 in the gravity direction. As shown in FIG. 4, the air discharge port 310 may extend from the upper region to the side region of the circulation path forming housing 301 along the internal circulation path 320. Thus, the area of the air discharge port 310 may be enlarged to further lower the air pressure in the developer discharge unit 211, and excessive discharge of the developer may be prevented.

The filter 330 has a shape capable of covering the upper region and the side region of the circulation path forming housing 301. The filter 330 may be attached to, for example, the circulation path forming housing 301. A filter cover 340 may be coupled to the circulation path forming housing 301 while pressing the filter 330. For example, the filter cover 340 may include a resilient metal plate or plastic. Thus, the filter 330 may be stably installed in the air discharge port 310.

Figure 6:
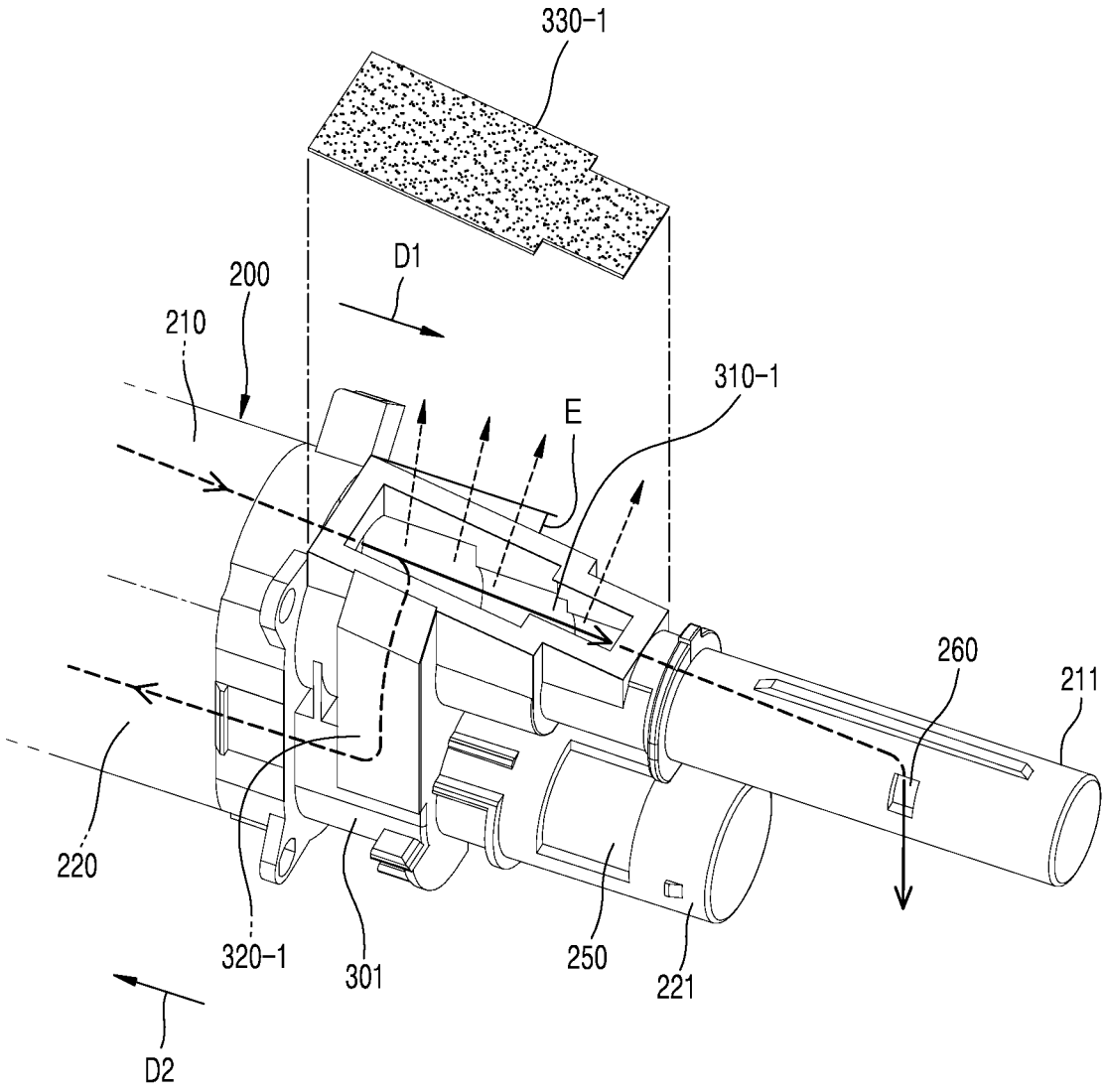
FIG. 6 is a partially exploded perspective view of an example of a developing device to which an air pressure relief structure is applied.

FIG. 6 is a partial exploded perspective view of an example of the developing device 10 to which an air pressure relief structure is applied. Referring to FIG. 6, an air discharge port 310-1 is provided between the developer conveying unit 200 and the developer discharge unit 211 such that air in the developer conveying unit 200 is discharged. For example, the air discharge port 310-1 may be located between the developing chamber 210 and the developer discharge unit 211. The air discharge port 310-1 is provided with a filter 330-1 for filtering a developer so that the developer is not discharged together with air. The developing device 10 includes an internal circulation path 320-1 provided between the developer conveying unit 200 and the developer discharge unit 211 and connecting the developing chamber 210 to the stirring chamber 220 to form an air passage. A structure of the internal circulation path 320-1 is the same as that of the internal circulation path 320 shown in FIG. 5.

The air discharge port 310-1 extends beyond the internal circulation path 320 and toward the developer discharge unit 211. The air discharge port 310-1 is formed to be inclined in the longitudinal direction of the developing roller 13 (or the flow direction of air flowing toward the developer discharge unit 211). The air discharge port 310-1 may be formed to be inclined downward to form an angle E in the longitudinal direction of the developing roller 13. The air directed from the developing chamber 210 to the developer discharge unit 211 smoothly moves along an inclined surface of a filter 330-1 installed in the air discharge port 310-1 extending long and oblique in an air flow direction and may be effectively discharged through the air discharge port 310-1 by passing through the filter 330-1.

According to this configuration, some of the air moving in the first direction D1 from the developing chamber 210 is discharged to the outside of the developer conveying unit 200 through the air discharge port 310-1 and some of the air is circulated to the stirring chamber 220 through the internal circulation path 320-1, and the rest is discharged through the developer discharge port 260. Therefore, the influence of the increase of the air pressure in the developing chamber 210 on the discharge speed and the discharge amount of the developer through the developer discharge port 260 may be reduced, and excessive discharge of the developer may be prevented.

Figure 7:
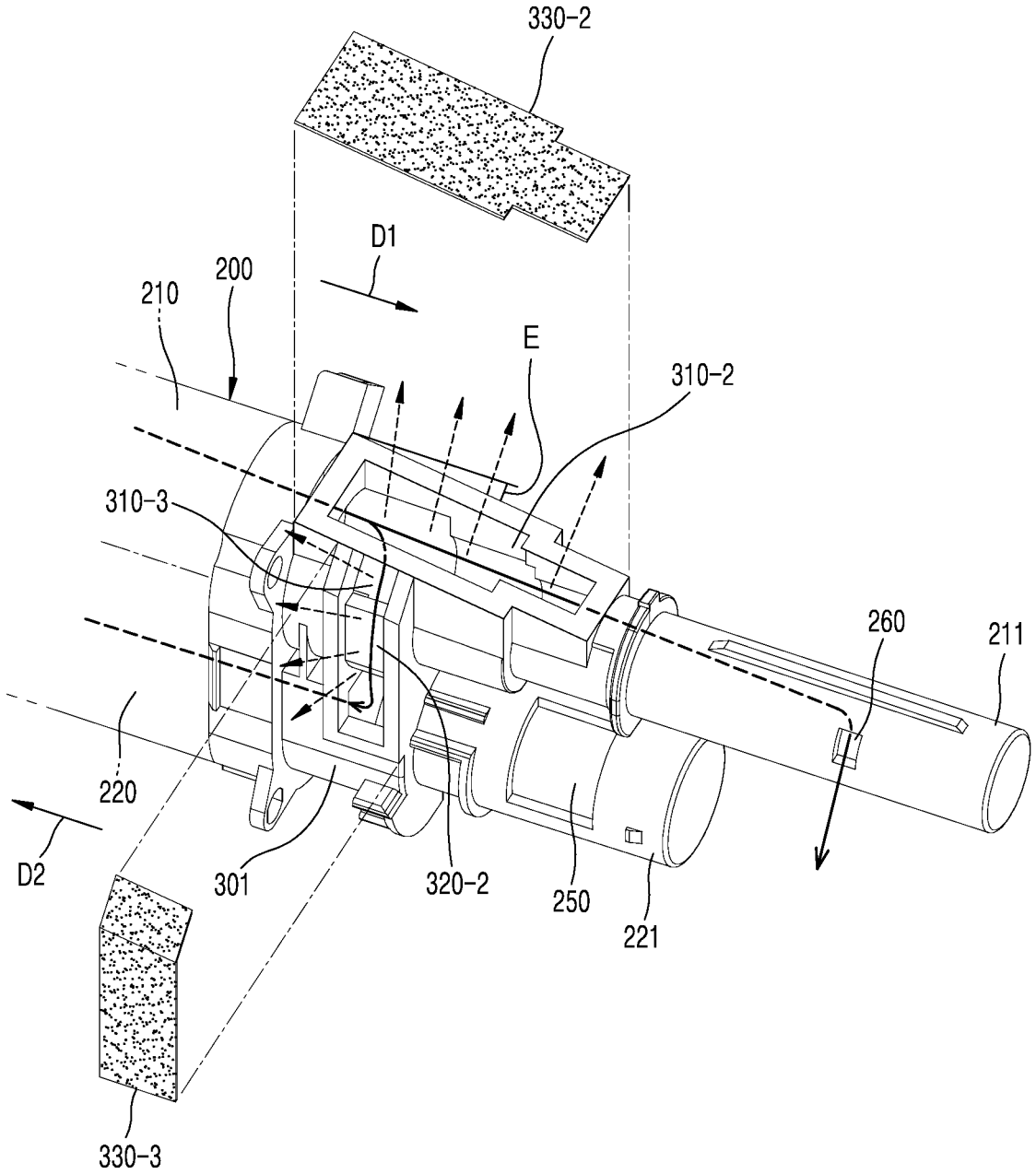
FIG. 7 is a partially exploded perspective view of an example of a developing device to which an air pressure relief structure is applied.

FIG. 7 is a partial exploded perspective view of an example of the developing device 10 to which an air pressure relief structure is applied. Referring to FIG. 7, an air discharge port is provided between the developer conveying unit 200 and the developer discharge unit 211 such that air in the developer conveying unit 200 is discharged. For example, the air discharge port may be between the developing chamber 210 and the developer discharge unit 211. The air discharge port is provided with a filter for filtering a developer so that the developer is not discharged together with air. The developing device 10 includes an internal circulation path 320-2 provided between the developer conveying unit 200 and the developer discharge unit 211 and connecting the developing chamber 210 to the stirring chamber 220 to form an air passage. A structure of the internal circulation path 320-2 is the same as that of the internal circulation path 320 shown in FIG. 5.

The air discharge port includes a first air discharge port 310-2 which extends beyond the internal circulation path 320 and toward the developer discharge unit 211 and is inclined in the longitudinal direction of the developing roller 13 (or the flow direction of the air flowing toward the developer discharge unit 211) and a second air discharge port 310-3 open in an outer wall forming the internal circulation path 320-2, that is, the circulation path forming housing 301. The first air discharge port 310-2 may be formed to be inclined downward to form the angle E in the longitudinal direction of the developing roller 13. The filter includes first and second filters 330-2 and 330-3, which are installed in the first and second air discharge ports 310-2 and 310-3, respectively.

According to this configuration, the air directed from the developing chamber 210 to the developer discharge unit 211 smoothly moves along an inclined surface of the first filter 330-2 installed in the first air discharge port 310-2 extending long and oblique in an air flow direction and may be effectively discharged through the first air discharge port 310-2 by passing through the first filter 330-2. Furthermore, some of the air moving in the first direction D1 from the developing chamber 210 is circulated to the stirring chamber 220 through the internal circulation path 320-2. Also, some of the air moving along the internal circulation path 320-2 passes through the second filter 330-3 and is discharged through the second air discharge port 310-3. Therefore, the influence of the increase of the air pressure in the developing chamber 210 on the discharge speed and the discharge amount of the developer through the developer discharge port 260 may be further reduced, and excessive discharge of the developer may be prevented.

Figure 8:
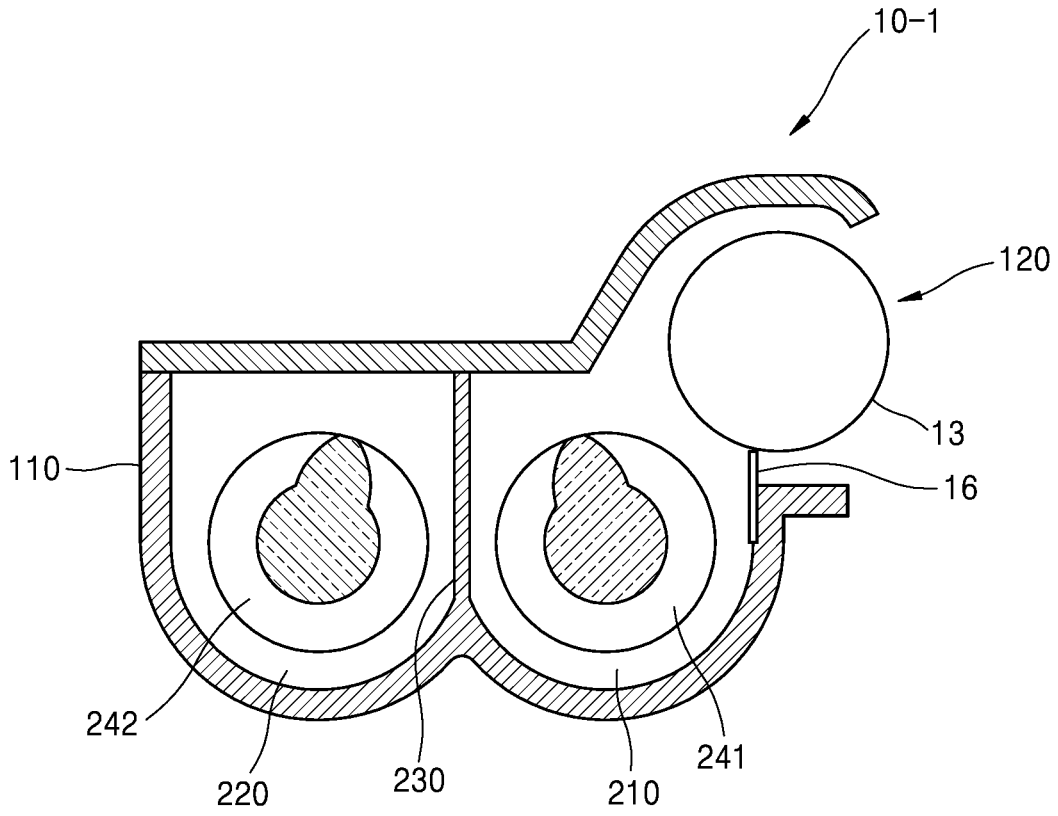
FIG. 8 is a cross-sectional view of an example of a developing device.

Although the developing device 10 in which the developing chamber 210 is above the stirring chamber 220 has been described in the above examples, the developing chamber 210 and the stirring chamber 220 may be arranged in parallel to each other in a horizontal direction. FIG. 8 is a cross-sectional view of an example of a developing device 10-1. Referring to FIG. 8, the developing device 10-1 of the present example is different from the above-described developing device 10 in that the developing chamber 210 and the stirring chamber 220 are arranged in parallel to each other in a horizontal direction and the remaining components are the same as those of the above-described developing device 10. Therefore, although not shown in FIG. 8, the same components as those of the developing cartridge 10 are denoted by the same reference numerals.

The developing chamber 210 and the stirring chamber 220 are separated from each other in a horizontal direction by the barrier wall 230. Although not shown in the drawings, the first and second communication ports 231 and 232 are provided at both ends of the barrier wall 230. The developer is moved from the developing chamber 210 to the stirring chamber 220 in a horizontal direction through the first communication port 231, and is moved from the stirring chamber 220 to the developing chamber 2120 in a horizontal direction through the second communication port 232. The developer supply unit 221 may extend from the stirring chamber 220 in the first direction D1 and the developer discharge unit 211 may extend from the development chamber 210 in the first direction D1.

The air discharge ports, filters, and internal circulation paths described in FIGS. 4 to 7 may also be applied to the developing device 10-1 of the present example. Therefore, the influence of the increase of the air pressure in the developing chamber 210 on the discharge speed and the discharge amount of the developer through the developer discharge port 260 may be further reduced, and excessive discharge of the developer may be prevented.

While examples have been described with reference to the figures, it will be understood by those of ordinary skill in the art that various changes in form and details may be made therein without departing from the spirit and scope as defined by the following claims.

What is claimed is:

1. A developing device comprising:

a developing roller;

a developer conveying unit comprising a developing chamber provided with the developing roller and extending in a longitudinal direction of the developing roller, a stirring chamber arranged in parallel to the developing chamber, and a barrier wall having a first communication port and a second communication port, at respective ends in the longitudinal direction, to connect the developing chamber with the stirring chamber;

a developer discharge unit extending from the developer conveying unit in the longitudinal direction of the developing roller and including a developer discharge port to discharge excess developer; and an air discharge port to house a filter to filter a developer, the air discharge port being provided between the developer conveying unit and the developer discharge unit to discharge air in the developer conveying unit.

2. The developing device of claim 1, further comprising:

an internal circulation path provided between the developer conveying unit and the developer discharge unit and connecting the developing chamber to the stirring chamber to form an air passage.

3. The developing device of claim 2, wherein the internal circulation path includes a first connection opening and a second connection opening connected to the developing chamber and the stirring chamber, respectively, wherein the first connection opening is connected to a downstream side of the developing chamber with reference to a flow direction of the developer in the developing chamber, and the second connection opening is connected to an upstream side of the stirring chamber with reference to a flow direction of the developer in the stirring chamber.

4. The developing device of claim 3, wherein the second connection opening is to open in the flow direction of the developer in the stirring chamber.

5. The developing device of claim 3, wherein the developer discharge unit extends from the downstream side of the developing chamber with reference to the flow direction of the developer in the developing chamber.

6. The developing device of claim 2, wherein the air discharge port is to open in a circulation path forming housing forming the internal circulation path.

7. The developing device of claim 2, wherein the air discharge port extends beyond the internal circulation path toward the developer discharge unit and is inclined in the longitudinal direction.

8. The developing device of claim 2, wherein the air discharge port comprises a first air discharge port extending beyond the internal circulation path and toward the developer discharge unit and is inclined in the longitudinal direction and a second air discharge port to open in an outer wall forming the internal circulation path, and the filter comprises first and second filters located in the first and second air discharge ports, respectively.

9. A developing device comprising:

a developing roller;

a developer conveying unit comprising a developing chamber provided with the developing roller and extending in a longitudinal direction of the developing roller, a stirring chamber arranged in parallel to the developing chamber, and a barrier wall having a first communication port and a second communication port, at respective ends in the longitudinal direction, to connect the developing chamber with the stirring chamber;

a first conveying member located in the developing chamber to convey a developer from the second communication port in a first direction;

a second conveying member located in the stirring chamber to convey a developer from the first communication port in a second direction opposite to the first direction;

a developer discharge unit extending from the developing chamber in the first direction and including a developer discharge port to discharge excess developer; and an air discharge port to house a filter to filter a developer, the air discharge port being provided between the first communication port and the developer discharge unit to discharge air in the developer conveying unit.

10. The developing device of claim 9, further comprising:

an internal circulation path provided between the first communication port and the developer discharge unit and connecting the developing chamber to the stirring chamber to form an air passage.

11. The developing device of claim 10, wherein the internal circulation path includes a first connection opening and a second connection opening connected to the developing chamber and the stirring chamber, respectively, wherein the first connection opening is between the first communication port and the developer discharge port, and the second connection opening is between the second communication port and a supply port.

12. The developing device of claim 11, wherein the second connection opening is to open in the second direction.

13. The developing device of claim 10, wherein the air discharge port is to open in a circulation path forming housing forming the internal circulation path.

14. The developing device of claim 10, wherein the air discharge port extends beyond the internal circulation path and toward the developer discharge unit and is inclined in the longitudinal direction.

15. The developing device of claim 10, wherein the air discharge port comprises a first air discharge port extending beyond the internal circulation path and toward the developer discharge unit and is inclined in the longitudinal direction and a second air discharge port to open in an outer wall forming the internal circulation path, and the filter comprises first and second filters located in the first and second air discharge ports, respectively.

* * * * *